US006032582A

United States Patent [19]

Franz et al.

[11] Patent Number: 6,032,582

[45] Date of Patent: Mar. 7, 2000

[54] SYSTEM AND METHOD FOR OPTIMALLY CONTROLLING THE RESTART OF A SHEET-FED OFFSET PRINTING OPERATION

[75] Inventors: Karl-Heinz Franz, Aschaffenburg; Achim Stoffler, Offenbach; Alexander Kluh, Sinntal; Joachim Muller, Pullach; Peter Schramm, Frankfurt, all of Germany

[73] Assignee: MAN Roland Druckmaschinen AG, Germany

[21] Appl. No.: 09/302,540

[22] Filed: Apr. 30, 1999

[30] Foreign Application Priority Data

May 2, 1998 [DE] Germany ..... 198 19 651

[51] Int. Cl.[7] ..... B41F 1/54

[52] U.S. Cl. ..... 101/484; 101/483; 101/485; 101/350.3; 101/352.06

[58] Field of Search ..... 101/484, 483, 101/485, DIG. 32, 231, 232, 349.1, 350.3, 352.01, 352.02, 352.06

[56] References Cited

U.S. PATENT DOCUMENTS 5,533,448 7/1996 Klingler ..... 101/233

5,845,576 12/1998 Junghans ..... 101/484

FOREIGN PATENT DOCUMENTS 43 33 071 C1 2/1995 Germany .

196 13 360 10/1997 Germany .

*Primary Examiner*—John Hilten

*Assistant Examiner*—Minh H. Chau

*Attorney, Agent, or Firm*—Leydig, Voit & Mayer, Ltd.

[57] ABSTRACT

A method and a corresponding control are described for the start-up of production printing in a sheet-processing printing machine, in particular, a sheet-fed offset printing machine, in which ink is supplied via a vibrating roller which is movable back and forth between an ink fountain roller and a ink distribution roller wherein clearance is given for the entry into the machine of a first sheet to be printed as a function of the state of movement of the vibrating roller. When production printing is resumed, the state of movement of the vibrating roller for clearance for the sheet entry is selected from a memory as a function of the state of movement of the vibrating roller during entry of a last sheet into the machine before the commencement of the print interruption.

7 Claims, 1 Drawing Sheet

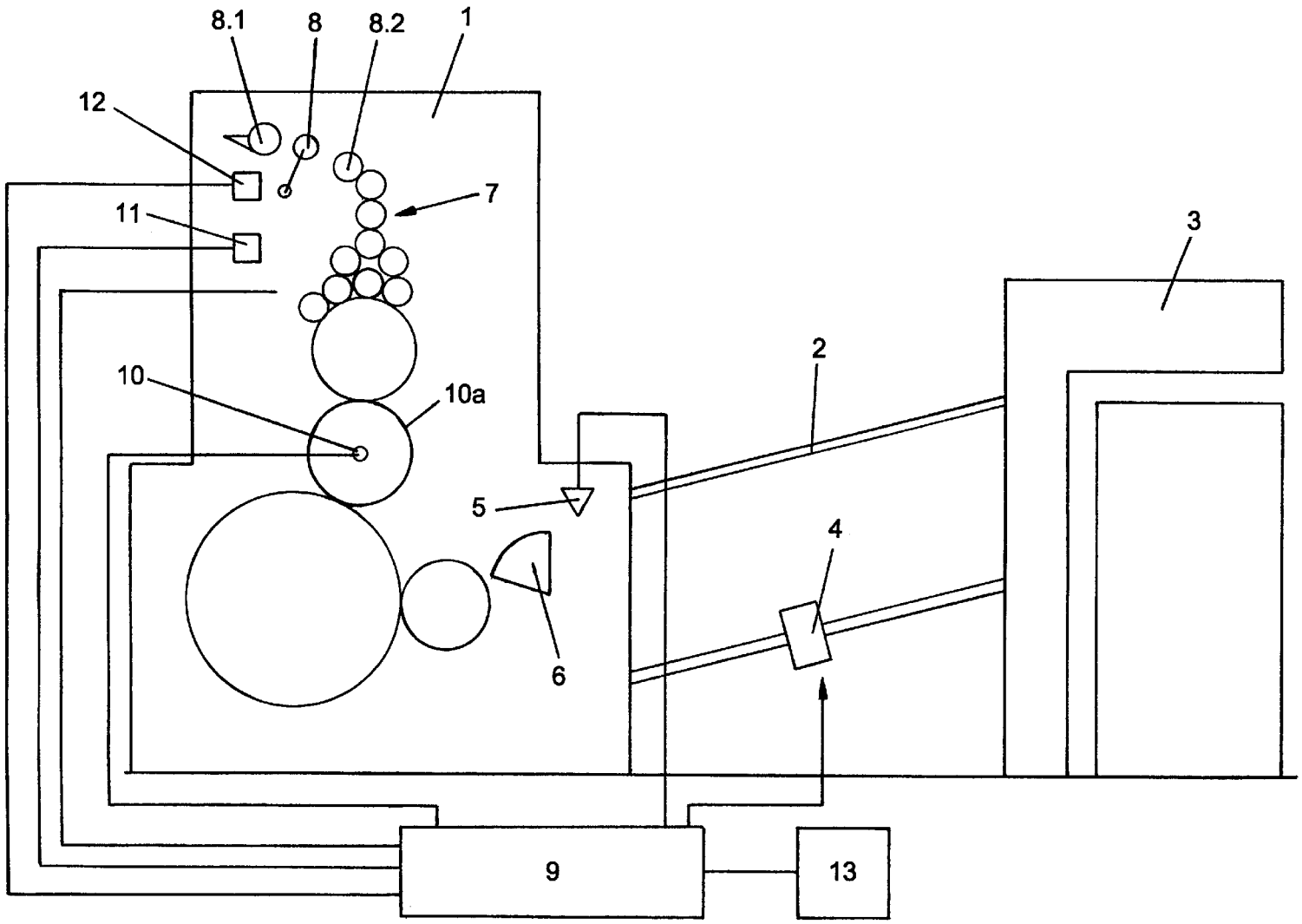
1
2
3
4
5
6
7
8
8.1
8.2
9
10
10a
11
12
13

SYSTEM AND METHOD FOR OPTIMALLY CONTROLLING THE RESTART OF A SHEET-FED OFFSET PRINTING OPERATION

TECHNICAL FIELD

This invention relates generally to sheet printing and, more particularly, relates to a system and method for optimally controlling the restart of a sheet-fed offset printing operation.

BACKGROUND OF THE INVENTION

In sheet-processing printing machines and, in particular, sheet-fed offset printing machines, ink is supplied to the form or plate cylinder from an ink fountain roller, cooperating with ink-metering elements, via an intermittent vibrating roller and a number of inking rollers. The ink layer on the plate cylinder is additionally split via a rubber blanket and, thus, passes indirectly onto the print carrier. Disadvantageously, the large number of rollers and the accompanying splitting operations tend to slow the overall ink transfer process. Furthermore, a specific number of machine revolutions is required before a desired ink layer-thickness is established on the rollers of the printing unit. Correctly printed sheets are obtained only when an ink-layer thickness profile corresponding to the ink requirement of the print subject is established on the inking rollers. Therefore, if this ink-layer thickness is disturbed, for example, by a stoppage of the transportation of ink while the printing machine continues to run, the desired print results will not be achieved until the desired ink-layer thickness is again reestablished.

To address this problem, various methods have been developed to achieve as quickly as possible the desired ink layer-thickness gradient. For example, one known method employs a pre-fill of the inking unit with a specific ink quantity so as to give the inking unit specific transverse profiles after ink metering begins. Nevertheless, these methods serve only to shorten the setting-up operation from one print order to the next and fail to address the situation arising from an ink supply stoppage when the ink-layer thickness gradient established on the individual inking rollers during production is effectively destroyed.

In the case of an ink supply stoppage, once printing is resumed, with clearance for the movement of the vibrating roller and with the ink applicator rollers and the cylinders being switched on in the correct sequence to print, the first sheet and a number of those following will exhibit inking which deviates markedly from the desired inking. Such systems are described in, for example, U.S. Pat. No. 5,845,576 (corresponding to DE 196 13 360) and U.S. Pat. No. 5,533,448 (corresponding to DE 43 33 071). Generally, this deviation results from the fact that the leveling operations (i.e., splitting operations) proceed as the machine continues to run even when ink flow has stopped. Therefore, using the aforementioned method does not afford any improvement in this scenario since the resumption of the correct ink-layer thickness requires a multiplicity of machine revolutions without any paper runs thereby interrupting and further delaying the printing process. While it has also been proposed to carry out so-called "inking-unit separation" at the time of such an ink stoppage, i.e., to stop the roller train of the inking unit at a multiplicity of points thus causing the ink-layer thickness on the individual inking rollers to be frozen, this measure is nevertheless unsatisfactory since it is highly complicated in terms of construction and, moreover, the turning on and off of the inking rollers results in additional faults.

SUMMARY OF THE INVENTION

The object of the present invention is, therefore, to provide a method for controlling the restart of production printing in such a way that, while the above-mentioned disadvantages are avoided, the spoilage occurring during a restart after a print interruption is avoided.

In accordance with this objective, the present invention is generally realized in a method and a corresponding control for the start-up of production printing in a sheet-processing printing machine, in particular, a sheet-fed offset printing machine, in which ink is supplied via a vibrating roller, which is movable back and forth between an ink fountain roller and a ink distribution roller, and wherein clearance is given for the entry into the machine of a first sheet to be printed as a function of the state of movement of the vibrating roller. When production printing is resumed, the state of movement of the vibrating roller for clearance for the sheet entry is selected from a memory as a function of the state of movement of the vibrating roller during entry of a last sheet into the machine before the commencement of the print interruption. In this manner, spoilage occurring during a restart after print interruption is appreciably reduced.

Additional features and advantages of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawing which illustrates a side-view schematic diagram of a sheet-fed offset printing machine constructed in accordance with the invention.

DETAILED DESCRIPTION OF THE INVENTION

Turning to FIG. 1, the invention is illustrated as being implemented in a sheet-fed offset printing machine 1. The sheet-fed offset printing machine 1 receives, via a conveying table 2, sheets to be printed. The sheets to be printed are stored in a stack set up in a feeder 3. To drive the feeder, the feeder 3 is coupled to the drive of the sheet-fed offset printing machine 1 via a switchable coupling 4. To ensure that the sheets are being correctly fed into the sheet-fed offset printing machine 1 via the conveying table 2, the sheet-fed offset printing machine 1 includes a feed check 5. A pregripper 6, that operates in cooperation with the feed check 5, functions to grasp and supply correctly feed sheets to the first printing unit.

The first printing unit includes an inking unit 7 with an ink fountain roller 8.1, a vibrating roller 8 and a downstream inking or distributing roller 8.2. The vibrating roller 8 is adapted to move back and forth between the ink fountain roller 8.1 and the distribution roller 8.2. For this purpose, the vibrating roller 8 may be driven by either a cam drive or a separate electric drive. Nevertheless, the phase of movement of the vibrating roller 8 (i.e., the back and forth movement between the ink fountain roller 8.1 and the distribution roller 8.2) is intended to be in phase with the movement of the printing unit.

The phase of the vibrating roller 8 can be described as the vibrating roller 8 moving through the following positions: 1) the vibrating roller 8 is in contact with the ink distribution roller 8.2; 2) the vibrating roller 8 is on its way to the ink fountain roller 8.1; 3) the vibrating roller 8 is in contact with the ink fountain roller 8.1; or 4) the vibrating roller 8 is on its way to the ink distribution roller 8.2. Furthermore, it will be appreciated that a given number of plate cylinder cycles occurs during the phase of the vibrating roller 8. For example, a vibrating-roller stroke of 3:1 signifies that the machine proceeds through three revolutions during one phase of the vibrating roller.

For controlling the operation of the sheet-fed offset printing machine 1, a control unit 9 is provided. In this regard, the control unit 9 may be a personal computer, programmable logic controller (PLC) or like type of device capable of receiving input signals, generating output signals and performing decisions based on instructions stored in RAM, ROM or other form of memory. The control unit 9 is operatively connected to the coupling 4 of the feeder, to the feed check 5, to an actuator 12 and to a sensor 11. The actuator 12 is provided for blocking the movement of (turning off) the vibrating roller 8. The sensor 11 is provided for detecting the phase relationship of the vibrating roller 8 with respect to a given print cylinder, for example, the rubber-blanket cylinder 10*a*, in the first printing unit. As illustrated, an angle encoder 10 is used to monitor the phase of the given cylinder in the first printing unit.

In operation, the control unit 9 receives a signal from the feed check 5 which signal is indicative of the state of the sheets being fed into the sheet-fed offset printing machine 1. Preferably, the feed check 5 provides this signal to the control unit 9 at times that are specified as a function of signals received from the angle encoder 10. If the feed check 5 notifies the control unit 9 that a sheet has not been properly fed, e.g., a sheet is not oriented correctly, a sheet is missing, the last sheet has been fed into the offset printing machine 1, etc., the control unit 9 causes the pregripper 6 to be blocked and further blocks the feeding of paper from the feeder 3 to the printing unit. At this time, the control unit 9 also detects the position or phase relationship of the vibrating roller 8 with respect to the ink fountain roller 8.1 and the distribution roller 8.2 from signals received from the sensor 11. This position is preferably stored in a memory 13 associated with the control unit 9. The control unit 9 also blocks further movement of the vibrating roller 8 by activating the actuator 12.

To restart the printing process once the sheet fault is eliminated, the control unit 9 determines when to resume the sheet run as a function of the position of the vibrating roller 8 at the time of the print operation stoppage. This position is read from the memory 13 at the time of restart. The memory 13 also has stored therein various optimum positions of the vibrating roller 8 for use in restarting the printing procedure, i.e., the time at which to feed the first sheet into the machine. In particular, an optimum position for the vibrating roller 8 for restarting the machine is selected from the memory 13 as a function of the position of the vibrating roller 8 at the commencement of the stop operation preferably taking into account the time length duration of the stop operation. The time length of the stoppage is preferably measured as a function of the number of revolutions of the print cylinder.

More specifically, during the restart procedure, the control unit 9 reads the optimum position of the vibrating roller 8 from the memory 13 based on the above-noted criteria, removes the block from the vibrating roller 8 by sending a signal to the actuator 12, and removes the block from the feeder 3 and pregripper 6 at an appropriate time such that the first sheet of paper enters the offset printing machine 1 when the vibrating roller 8 is in the selected optimum position. For example, within the memory 13 there may be stored data that causes the control unit 9 to start the sheet feed operation exactly when the vibrating roller 8 comes into contact with the distribution roller 8.2 of the inking unit 7 if the stoppage has lasted for more than 6 revolutions when, at the commencement of the stoppage, the vibrating roller 8 was on its way to the ink fountain roller. Thus, the optimum position for the vibrating roller 8 when sheet feeding is commenced need not correspond to the position of the vibrating roller 8 at the time of the stoppage. Rather, the optimum position of the vibrating roller 8, preferably determined experimentally, may take on any position in the phase of the vibrating roller 8.

Additional criteria may also be used in determining when to restart the printing process. In this regard, the phase of the vibrating roller 8 for switching on the sheet run may also be determined as a function of the surface coverage of the printed sheet (average surface coverage). Moreover, the inking-unit geometry, the size of the inking unit, the type of roller separation and other factors critical for the ink flow may be additionally accounted for. When such additional criteria are utilized, the memory 13 would accordingly contain a multiplicity of switch-on conditions for the sheet run, in relation to the position of the vibrating roller 8 at the time of the commencement of the stoppage, taking into account the values such other criteria may achieve.

By way of further illustration to explain the operating mode of the control unit 9, assuming that there is a stoppage which lasts for 5 revolutions in a first case and for 25 revolutions in a second case, both cases assuming that the stoppage commenced at a time when the vibrating roller 8 came into contact with the distribution roller 8.2, there are stored in the memory 13 provisions for switching the sheet run on again. It the first case, the sheet run is turned on again when the vibrating roller 8 is still just bearing on the inking roller 8.2 or is on its way to the ink fountain roller 8.1. In the second case, the advantageous time for switching the sheet run on again may be during the vibrator phase when the vibrating roller 8 is in contact with ink fountain roller 8.1.

All of the references cited herein, including patents, patent applications, and publications, are hereby incorporated in their entireties by reference.

In view of the many possible embodiments to which the principles of this invention may be applied, it should be recognized that the embodiment described herein with respect to the drawing figure is meant to be illustrative only and should not be taken as limiting the scope of invention. For example, those of skill in the art will recognize that the elements of the illustrated embodiment described as being implemented by control unit 9 instructions may be implemented in hardware and that the illustrated embodiment can be modified in arrangement and detail without departing from the spirit of the invention. Therefore, the invention as described herein contemplates all such embodiments as may come within the scope of the following claims and equivalents thereof.

We claim:

1. A method for restarting production printing in a sheet-processing printing machine in which ink is supplied via a vibrating roller which is movable back and forth between an ink fountain roller and a distribution roller, the method comprising the steps of:

detecting a first position of the vibrating roller at a time that production printing is stopped;

stopping the movement of the vibrating roller;

selecting from a memory, as a function of the first position, a second position corresponding to a position in which the vibrating roller is to be located before clearing the entry of a first sheet into the machine;

causing the vibrating roller to resume movement; and when the vibrating roller achieves the second position, clearing the entry of the first sheet into the machine thereby restarting production printing.

2. The method according to claim 1, further comprising the step of using the time length of the production printing stoppage when selecting the second position.

3. The method according to claim 2, further comprising the step of using an ink requirement of a print subject when selecting the second position.

4. The method according to claim 2, further comprising the step of using an average surface coverage area of a printing form when selecting the second position.

5. The method according to claim 2, further comprising the step of using an inking-unit geometry measurement when selecting the second position.

6. A sheet-processing printing machine for use in production printing a plurality of sheets, comprising:

a vibrating roller which is movable back and forth between an ink fountain roller and a distribution roller;

an inking unit in fluid communication with the distribution roller for applying ink to the plurality of sheets;

a controllable feed unit for feeding the plurality of sheets to the inking unit;

a sensor for generating a signal indicative of a state of movement of the vibrating roller;

a memory in which are stored a plurality of positions for the vibrating roller; and a control unit connected to the sensor, the controllable feed unit and the memory, the control unit including instructions for performing the steps comprising: detecting a first position of the vibrating roller at a time that production printing is stopped; stopping the movement of the vibrating roller; selecting from the memory, as a function of the first position, a second position corresponding to a position in which the vibrating roller is to be located before clearing the entry of a first sheet into the machine; causing the vibrating roller to resume movement; and, when the vibrating roller achieves the second position, clearing the entry of the first sheet into the machine thereby restarting production printing.

7. The printing machine as recited in claim 6, wherein the control unit further comprises instructions for using the time length of the production printing stoppage when selecting the second position.

* * * * *